United States Patent [19]

Allen et al.

[11] Patent Number: 4,684,549

[45] Date of Patent: Aug. 4, 1987

[54] IRON ORE PELLETIZATION

[75] Inventors: Anthony P. Allen, West Yorkshire, England; Sten Forsmo, Malmberget, Sweden; John G. Langley, West Yorkshire, England

[73] Assignee: Allied Colloids Limited, England

[21] Appl. No.: 935,006

[22] Filed: Nov. 26, 1986

[30] Foreign Application Priority Data

Nov. 29, 1985 [GB] United Kingdom ..... 8529418

[51] Int. Cl.[4] ..... B05D 7/00; C22C 1/04; H01F 1/02

[52] U.S. Cl. ..... 427/221; 75/0.5 BA; 148/105; 427/127

[58] Field of Search ..... 75/0.5 BA, 1 R; 427/221, 127; 148/105; 252/62.54, 62.56

[56] References Cited

U.S. PATENT DOCUMENTS

| | | | |
|---|---|---|---|
| 4,050,962 | 9/1977 | Koester et al. | 75/0.5 BA |
| 4,248,907 | 2/1981 | Uehori et al. | 148/105 X |
| 4,470,844 | 9/1984 | Rademachers et al. | 75/0.5 BA |

*Primary Examiner*—Michael R. Lusignan
*Attorney, Agent, or Firm*—Ostrolenk, Faber, Gerb & Soffen

[57] ABSTRACT

Finely particulate iron ore is pelletized using finely particulate, free flowing, anionic water soluble synthetic polymer having intrinsic viscosity of from 3 to 16 as binder.

18 Claims, No Drawings

IRON ORE PELLETIZATION

Iron ore needs to be in the form of agglomerates of substantial size when it is charged into a blast furnace. If the available ore is in the form of particles that are too small for direct feed to the blast furnace it is necessary to convert them to a sinter or to pellets. With the increasing use of lower grade ores it has become necessary to grind the ore more finely and, for these fine particles, pelletisation is the only satisfactory method of production of feedstock for the furnaces.

The pellets are made by adding binder to the fine particulate ore and stirring in the presence of a small amount of water (generally moisture in the ore) to form a moist mixture, and then pelletising the mixture, e.g., in a balling drum or disc pelletiser. The green pellets are then fired in a kiln through a temperature range that extends from an inlet temperature typically in the range 200°–400° C. up to a final temperature of e.g., 1200° C.

Important properties of the pellets are the initial or wet strength, the dry strength (after drying the green pellets in an oven at 105° C.) and the tendency of the pellets to spall (or burst) upon exposure to firing temperatures. The tendency for spalling can be defined by determining the minimum temperature at which spalling occurs or by observing the percentage of fines formed during a particular firing cycle. The moisture content of the mixture and the porosity of the pellets must be chosen carefully. A high "drop number" for the green pellets is desirable. For cost reasons the amount of binder should be as low as possible and, to ensure uniform properties, its flow properties must be such that it can easily be added uniformly in these low quantities.

Although many binders have been proposed in the literature, (e.g., bentonite and other clays, ferrous sulphate, lignin sulphate, asphalt, starches, calcium and sodium compounds, and certain polymers) in practice bentonite is the binder that is generally used.

In GB No. 1,324,838 work was described that was conducted in or before 1970, more than 15 years ago. This used, as binder, a water soluble linear organic polymer having a molecular weight of 1 million to 20 million. Suitable polymers were modified natural polymers such as starch and sodium carboxymethyl cellulose and various non-ionic, anionic or cationic synthetic polymers. The process involved forming a solution of the polymer and spraying the solution on to the particulate iron ore. The patent noted that the sprayed solution was viscous and that this could be a problem, but that the viscosity could be reduced by including sodium chloride, sodium sulphate or potassium chloride in the water used for making the solution.

Although direct comparisons of the polymers in GB No. 1,324,838 is difficult it appears from the patent that various non-ionic, anionic and cationic polymers can be used to give improved green strength and/or spalling properties compared to bentonite, at very much lower dosages than bentonite. For instance a straight chain polyethylene oxide was reported as giving improved strength and spalling values and a cationic copolymer and a polymer formed from about 8% sodium methacrylate and 92% acrylamide were reported as giving improved strength values.

A disadvantage of the process in GB No. 1,324,838 is that it is necessary to introduce substantial amounts of water with the polymer and so the initial iron ore must be very dry (involving the use of drying energy) or the final pellets will be very wet (increasing the risk of spalling).

In Aus.I.M.M. Newcastle Pellets and Granules Symposium October 1974 pages 151 to 156 R. L. Smythe describes what appears to be the same work as is discussed in this patent. It describes the problems that had been incurred with converting dry powder polymer into the polymer solution that could be sprayed on to iron ore. The article proposed the use of polymer supplied as a 35% solution (necessarily therefore involving bulk handling problems) and the use of polymer supplied as a liquid suspension, that presumably was converted to an aqueous solution before use. The article warned about handling problems of the resultant pellets and the risk of blockage of chutes and referred to the study of alternative polymers, namely "natural polymers and derivatives of petroleum products".

Despite all this work in the early 1970's an authoritative review of iron ore pelletisation by G. K. Jones in Industrial Minerals March 1979 pages 61 to 73 mentions, as binders, only Portland cement, lime and bentonite, and emphasises the large amount of bentonite that is used and predicts that it will continue to be used despite the shortages of bentonite.

Despite the acceptance by Jones, and the whole industry, that bentonite would continue to be the most widely used binder it has, for very many years, been recognised to incur various problems. Thus some grades of bentonite give satisfactory pellet properties but others are less satisfactory. A problem with all grades of bentonite is that the bentonite is not combustible and so contributes to the gangue in the furnace, and this gangue tends to be corrosive to the lining of the furnace. Another problem with bentonite is that the optimum grades are becoming less available. Bentonite must be present in the pellets in quite large amounts, thus reducing the iron content of the pellet significantly and increasing the amount of gangue. Lime and some inorganic salts have been proposed as alternatives to bentonite, but again they cause the formation of unwanted gangue and can be less satisfactory than bentonite. The added gangue constituents require increased energy consumption in the furnace.

A problem with bentonite and other binders is that the spalling temperature is low. Typically the inlet temperature of the kiln has to be in the range 200° to 400° C. to prevent spalling. Higher inlet temperatures would be economically desirable if spalling could still be avoided.

In Mining Engineering October 1984 pages 1437 to 1441 de Souza et al reported that organic binders would have the inherent advantage, over inorganic binders, of being eliminated during firing. Results were reported on the use of polymers based on cellulose, in particular the material sold under the trade name Peridur and which is believed to be carboxymethyl cellulose. The article reported adding Peridur powder to an aqueous pulp of iron ore before filtration and also reported adding the powder manually to the ore flow. The article noted the need for water soluble polymers to be hydrated and dissolved during mixing and pelletising.

Spalling at 250° C. was reported, but this is unsatisfactorily low.

A difficulty with powdered cellulosic binders such as carboxymethyl cellulose is that the irregular particle shape and size distribution is such that the powder does not flow freely. Instead the dry particles tend to clump together rather than flow over one another. As a result it is difficult to achieve uniform supply of the low dosages that are required. Another problem is that the amount of cellulosic binder that has to be used for adequate strength tends to be too high to be cost effective. Another problem with some cellulosic polymers is that they can reduce surface tension, and this appears to be undesirable in pellet formation.

In practice the use of cellulosic binders has not been widely adopted, presumably because of these or other problems. At present therefore there is very little use of organic binders and bentonite is still very widely used, despite the long-recognised disadvantages and decreasing availability of suitable grades of bentonite and despite the long-established possibility of using organic binder.

When considering possible binders that might be used there are several critical factors that have to be recognised. The iron ore always has a very small particle size, and therefore a huge surface area. The binder must be introduced with the absolute minimum of water in order that the pellets can conveniently have a total moisture content of not more than about 15%. The duration and energy of mixing the binder with the iron ore particles must be as short as possible in order to maximise production and minimise capital costs. The amount of binder must be as low as possible in order to minimise cost and to avoid the risk of excess binder accentuating the stickiness problems noted in the article by R. L. Smythe.

Bentonite has a very small particle size (typically below 10 μm) and adequate admixture of these very small particles with the particulate iron ore is achieved because the bentonite is used in a relatively large amount (typically 1%). However it would be expected that the use of a binder that is substantially coarser and/or present in a substantially smaller amount would tend to give less satisfactory results, due to non-uniform mixing of the binder with the relatively large volume of very fine particulate iron ore.

We have now surprisingly found that it is possible to obtain good properties, and in particular good spalling resistance and satisfactory strength properties, using very small amounts of a particular class of polymer that can easily be supplied in very free flowing powder form, so that controlled accurate application can easily be achieved. We also find that dose-effectiveness can be increased by adding certain simple, generally monomeric, compounds.

In the invention iron ore pellets are made by adding binder comprising organic polymer to particulate iron ore having substantially all particles below 25O μm and stirring in the presence of about 5 to about 15% by weight water (based on total mixture) to form a substantially homogeneous moist mixture and pelletising the moist mixture, and in this process the binder comprises about 0.01 to about 0.2% by weight (based on total mixture) of a water soluble synthetic polymer that has intrinsic viscosity (IV) from about 3 to about 16 dl/g and that is an anionic polymer of one or more water soluble ethylenically unsaturated monomers comprising an anionic monomer and that is added to the iron ore as dry, free flowing, powder having substantially all particles below about 300 μm.

Despite the suggestions in the prior art discussed above as to the suitability of soluble cationic or nonionic synthetic polymers and cellulosic polymers, we find that they are less effective than the anionic polymers used in the invention. Additionally we find that although it might have been expected to be desirable to use swellable but insoluble particles (in an attempt at matching the properties of bentonite) in fact the use of water swellable but insoluble polymer as the only polymer is also unsatisfactory. In particular the polymers used in the invention can satisfactorily be used in lower amounts than in practice are required with, for instance, carboxymethyl cellulose, can be added more easily, and give an excellent spalling temperature (often much higher than bentonite).

The failure of the cross-linked polymers, and the article in Mining Engineering October 1984 page 1438, might have indicated that it is necessary for the polymer to go into solution and/or to form a viscous phase during mixing, but we have surprisingly found that results can be improved (or the required polymer dose reduced) by the presence in the water of certain simple compounds. Many of these are monomeric, usually inorganic, electrolyte than can be shown experimentally to reduce the rate of solution and the viscosity when the polymer is dissolved into bulk water. However it appears that some mechanism other than depression of solubility or viscosity is involved. In practice the water is generally moisture that is present in the iron ore, remaining from a previous filtration stage, and this water is itself normally a solution of one or more inorganic electrolytes.

Although this contamination appears satisfactory we find results are improved further, and often synergistically if the powdered binder that is added to the ore includes additional monomeric compound that is usually an inorganic or organic electrolyte but can be a non-electrolyte. The compound amount typically is from about 5 to about 60% by weight based on the polymer.

The compound is normally water soluble and inorganic and so is preferably a water soluble salt of an acid. However salts of strong acids (e.g., sodium chloride, sulphate or nitrate) are less satisfactory than salts of weak organic acids or carbonic acid. The strong acid salts may generate corrosive acids during smelting or firing. Accordingly preferred compounds that are incorporated as part of the binder are organic molecules such as urea, inorganic water soluble salts of carboxylic, dicarboxylic and tricarboxylic acids such as sodium acetate, sodium citrate, sodium oslate, sodium tartrate, sodium benzoate and sodium stearate, other sodium salts of weak acids such as sodium bicarbonate and soidum carbonate, other miscellaneous sodium salts such as sodium silicate, the corresponding ammonium, potassium, calcium or magnesium salts of the preceding salts and calcium oxide. Sodium carbonate, bicarbonate or silicate are generally preferred as they give the best anti-spalling and dry strength results.

Preferably the compound is preblended with the polymer and the blend is added to the iron ore, or it can be added separately. Alternatively the compound can be within the polymer particles. For instance a salt of a weak acid can be present in the aqueous monomer during polymerisation.

The optimum amount of added salt or other compound can be found by experimentation. For many purposes it is in the range 0 to about 60% by weight based on the binder (below 0.1% and usually below 0.02% based on ore). In some instances amounts of from about 10 to about 30% based on soluble polymer are the most cost effective but usually greater amounts, for instance 30 to about 100% or even 150%, preferably 50 to 90%, based on soluble polymer are preferred.

The soluble polymer, optionally with the added salt or other compound, can be used in combination with other binders. In particular, despite the fact that cross linked polymers have proved, by themselves, to be unsatisfactory we find valuable results are achieved if a cross linked, swellable, particulate organic polymer is included with the soluble polymer. The cross linked polymer must have a small particle size, below 100 μm and often below 50 μm. The size can be as small as is commercially available, e.g., down to 10 μm or 1 μm. The particles are normally introduced as dry powder and conveniently this powder is in the form of fines separated during the production of coarser particulate swellable polymer, for instance as produced by gel polymerisation followed by comminution or by bead polymerisation. The inclusion of the cross linked polymer particles can give surprisingly improved dry strength and drop number values and so a blend of soluble particles and cross linked particles can give an excellent combination of dry strength, wet strength and spalling properties. Also the pellets tend to have improved surface appearance, such as smoothness.

The cross linked polymer may be non-ionic (e.g., polyacrylamide), but is preferably anionic and so may be formed from the same monomers as are discussed below for the preparation of the soluble polymer. Preferably 30to 100% by weight, most preferably 60 to 100% by weight, are anionic. The use of homopolymer, e.g., cross linked sodium polyacrylate, is very satisfactory. Cross linking may be by any of the conventional cross linking agents used in the production of swellable or absorbent polymers. Thus it may be by an ionic cross linking agent but is preferably covalent, e.g., methylene bis acrylamide or other polyethylenically unsaturated monomer. The amount of cross linking agent is generally in the range 20 to 1,000 ppm, preferably 50 to 500 ppm, and must be such that the particles are insoluble but highly swellable in water, e.g., having a gel capacity in water above 50, and preferably above 200, grams per gram.

The amount of cross linked polymer particles may be relatively low, e.g., 10 to 30% based on soluble polymer, but generally greater amounts, e.g., up to 300% or even 600% based on soluble polymer are preferred. Amounts of 0 to 80% often 20 to 50%, based on total binder are suitable. Particularly preferred binders consist essentially of 1 part by weight soluble polymer, 0.3 to 1.5 parts by weight sodium carbonate or other added salt or simple compound, and 0.3 to 5 parts by weight cross linked anionic homopolymer or copolymer, with proportions of about 1:1:1 often being convenient.

The polymer must be anionic. Preferably it is formed from a blend of anionic and non-ionic monomers. The monomers are generally acrylic but could be other vinyl or allyl monomers provided the final polymer is water soluble and has the desired intrinsic viscosity. The polymer is preferably formed from a blend of acrylamide and one or more anionic ethylenically unsaturated monomers. The amount of acrylamide is generally in the range 20 to 95% by weight of the monomers. The anionic monomer or monomers can include sulphonic monomers but preferably are carboxylic monomers. Accordingly various of the water soluble carboxylic (including polycarboxylic) ethylenically unsaturated acids can be used, including methacrylic acid, but acrylic acid is preferred. Any acid is generally present in the form of a water soluble salt, usually the sodium salt.

The amount of anionic monomer is generally at least about 5% and preferably at least about 20% but generally it is unnecessary for it to be present in an amount of more than about 50% or, at most, about 60%. Particularly preferred copolymers are formed by polymerisation of 30 to 40 or 50% by weight sodium acrylate and 50 or 60% up to 70% by weight acrylamide.

We have surprisingly found that the IV is important for reliable properties. It should be at least about 3 as otherwise the strength of the pellets is inadequate unless the amount of polymer is very high, and preferably is above 4. Similarly, results deteriorate if the intrinsic viscosity is too high, and so it is generally below 13 and preferably below about 11. With increasing IV, smaller amounts of polymer may be used but the proportions have to be selected more carefully for optimum properties. Preferably the intrinsic viscosity is above about 5 and preferably it is below about 8 or 9, with best results generally around 6, for instance in the range about 6 to about 8.

Substantially all the particles of the polymer must be below about 300 μm, presumably since otherwise the particle size is too large to establish adequate contact with the very large number of very small iron ore particles. Preferably substantially all the polymer particles are below about 200 and preferably below about 150 microns. Although it might be expected to be necessary to have exceedingly small polymer particle size, similar to bentonite, this is unnecessary and it is satisfactory for most or all of the particles to be above 20 microns. Best results are often achieved when substantially all the polymer particles are in the range 20 to 100 microns but a satisfactory fraction is 100% below about 200 μm and at least 50% below about 100 μm.

An important feature of the invention is that despite the very low particle size, and therefore huge surface area, of the ore good results are achieved at very low soluble polymer additions. The amount, therefore, is always below about 0.2% and generally it is below about 0.1% (by weight based on the total mix). It is often preferred for the amount to be below 0.05% by weight, but amounts below 0.01% are usually inadequate except when the soluble polymer is used with significant (e.g., at least 20% by weight) other binder components the amount of soluble polymer may then sometimes be reduced, e.g., to 0.005%.

The polymer can be made by bulk gel polymerisation followed by drying and comminution, but it is important that the polymer particles should be free flowing. Thus it should be possible to scatter the particles on to the iron ore substantially independent of each other and with substantially no aggregation or clumping of the polymer particles before they contact the iron ore. Comminution in air tends to give particles of a rough shape that do not flow as easily as would be desired but better flowing properties can be achieved by comminution in an organic liquid, for instance as described in EP No. 0169674. If the particles are made by comminution it may be necessary to sieve the particles to give the desired particle size range.

It is particularly preferred that the polymer particles should be in the form of substantially spherical beads. In particular the polymer particles are preferably made by reverse phase suspension polymerisation. Thus an aqueous solution of the chosen monomers is dispersed in water immiscible liquid, generally in the absence of an emulsifying agent but in the presence of an amphipathic polymeric stabiliser, the polymerisation is induced in conventional manner to provide a suspension of gel particles in the non-aqueous liquid, the suspension is then dried by azeotropic distillation and the particles are separated from the non-aqueous liquid in conventional manner. The desired particle size range is controlled in known manner, for instance by the choice of stabiliser, emulsifying agent (if present) and, especially, the degree of agitation during the formation of the initial suspension of aqueous monomer particles in the water immiscible liquid.

Many methods of handling or manufacturing gel polymer particles involve the utilisation of materials that depress surface tension. For instance comminution of gel may be associated with the use of such a material and reverse phase suspension polymerisation is often conducted in the presence of such materials. It is particularly desirable in the invention to make the polymer particles in the substantial absence of any such material. In particular, it is desirable that the entire binder (and also the polymer component of the binder) should have substantially no depressant effect on surface tension. Thus if binder is dissolved with water at 20° C. at 0.075% by weight concentration the surface tension of the solution should be above 65, and preferably above 70 dynes/cm.

The particle size of the iron ore is generally less than 250 microns, usually 90% or 80% by weight of the particles being less than 50 microns. The iron ore is preferably magnetite but can be haemetite or taconite. The iron ore can be contaminated with clay and it is surprising that, despite the water absorbing capacity of such clay, satisfactory results are still obtained in the invention.

Before adding the polymer the iron ore usually already has the desired final moisture content of 5 to 15%, preferably 8 to 10%, by weight based on the weight of iron ore. This moisture content is the moisture as measured by heating up to 105° C. However if the ore is too dry then water may be added to it, e.g., before or after the addition of polymer binder.

The binder can be blended with the iron ore in the same manner as bentonite is blended, preferably by scattering the polymer particles on to the iron ore as it is carried towards a mixer, for instance a paddle mixer provided with stators. It may be mixed for the same duration as when bentonite is used, for instance 2 to 20, generally about 10, minutes.

The damp blend of iron ore and polymer particles is converted to pellets in conventional manner, for instance by balling in conventional manner. This may be effected using a rotating tilting disc but generally is conducted in a balling drum. The size of the pellets is generally from 5 to 16 mm, preferably 8 to 12 mm.

Before the resultant green pellets can be utilised for the production of iron they need to be fired, generally at a temperature up to above 1000° C., for instance up to 1200° C. For this purpose they can be introduced into a kiln or other firing apparatus and fired in conventional manner. It is desirable to be able to introduce them into this furnace at the highest possible inlet temperature with the minimum risk of spalling. The inlet temperature at which spalling becomes significant can be referred to as the spalling temperature and a particular advantage of the invention is that it is possible to make pellets having a spalling temperature higher than can conveniently be obtained by the use of bentonite and other known binders.

The pellets of the invention have satisfactorily high wet strength and dry strength (measured after drying in an oven) and a satisfactorily high drop number when wet (indicating the number of drops before they shatter).

The following are some examples demonstrating the invention.

EXAMPLE 1

A linear copolymer of acrylamide with 35 to 40 weight percent sodium acrylate was made by reverse phase bead polymerisation followed by azeotropic distillation and screening in conventional manner. One grade of polymer, polymer A, was made to an intrinsic viscosity of 6.9 and another, polymer B, was made to an intrinsic viscosity of 10.7.

Each of the polymer types was screened to various maximum particle sizes and each polymer fraction was then used as a binder for particulate iron ore. The polymer beads were scattered on to moist particulate magnetite iron ore at a dosage of about 0.04% by weight. The amount of moisture was 8.8%. The blend was then converted to pellets in a balling drum, the pellets having a size typically of about 5–16 mm. The properties of the pellets made from polymer A are recorded in Table 1 and the properties of the pellets made from polymer B are recorded in Table 2.

TABLE 1

| Particle size/μm | Wet Strength/kg | Dry Strength/kg | Drop Number | % Moisture | % Porosity | Spalling Temp/°C. |
|---|---|---|---|---|---|---|
| −425 | 0.80 | 2.64 | 7.8 | 9.1 | 32.6 | +600 |
| −250 | 0.80 | 2.58 | 6.7 | 8.9 | 32.6 | +600 |
| −75 | 0.84 | 2.80 | 8.3 | 8.9 | 32.2 | +600 |

TABLE 2

| Particle size/μm | Wet Strength/kg | Dry Strength/kg | Drop Number | % Moisture | % Porosity | Spalling Temp/°C. |
|---|---|---|---|---|---|---|
| −600 | 0.85 | 2.32 | 8.0 | 8.9 | 32.6 | +600 |
| −425 | 0.77 | 1.84 | 7.4 | 9.0 | 32.9 | +600 |
| −250 | 0.80 | 2.24 | 9.0 | 9.0 | 32.6 | +600 |
| −150 | 0.88 | 2.38 | 8.8 | 8.9 | 32.4 | +600 |
| −75 | 0.97 | 2.90 | 10.2 | 8.9 | 32.1 | +600 |
| −38 | 0.88 | 2.73 | 9.4 | 9.0 | 32.4 | +600 |

The benefit of using the lowest particle sizes is demonstrated in both tables by the increased wet strength at lower particles sizes. The benefit of using a polymer having IV 6.9, rather than 10.7, is demonstrated by the improved dry strength in Table 1. All these polymers are resistant to spalling to above 600° C., which is very high compared to bentonite and to the temperature of 250° C. quoted by de Souza.

EXAMPLE 2

The process of Example 1 was repeated with various binders. The polymer had IV about 10 and was a copolymer of about 40% sodium acrylate with about 60% acrylamide. Table 3 shows the results for binders consisting of a single component and Table 4 shows the results for 0.04% additions of binder consisting of a blend of polymer:inorganic additive in the ratios specified in Table 4.

TABLE 3

| Binder | Amount Binder % w/w | Wet Strength/ 4 g Pellet/kg | Dry Strength/ 4 g Pellet/kg | Drop No. | % Moisture | % Spalled at 1000° C. |
|---|---|---|---|---|---|---|
| Blank | | 0.42 | 0.47 | 3.0 | 7.4 | 100 |
| Bentonite | 0.7 | 0.67 | 2.06 | 5.7 | 8.3 | 20 |
| Polymer | 0.04 | 0.53 | 1.27 | 4.6 | 8.4 | 0 |
| $NaHCO_3$ | 0.7 | 0.60 | 1.43 | 3.3 | 7.2 | 0 |
| $Na_2CO_3$ | 0.7 | 0.42 | 1.47 | 3.8 | 7.7 | 20 |
| $Na_3$Citrate | 0.7 | 0.40 | 6.02 | 3.9 | 7.4 | 0 |
| $NaNO_3$ | 0.7 | 0.42 | 0.67 | 3.7 | 7.5 | 60 |
| $CaCO_3$ | 0.7 | 0.54 | 0.30 | 2.9 | 7.6 | 100 |

TABLE 4

| Additive | Ratio | Wet Strength/ 4 g Pellet/kg | Dry Strength/ 4 g Pellet/kg | Drop No. | % Moisture | % Spalled at 1000° C. |
|---|---|---|---|---|---|---|
| $NaHCO_3$ | 95:5 | 0.59 | 1.38 | 8.7 | 8.6 | 20 |
| $NaHCO_3$ | 90:10 | 0.59 | 2.20 | 6.9 | 8.3 | 0 |
| $NaHCO_3$ | 80:20 | 0.67 | 1.21 | 7.1 | 8.3 | 0 |
| $NaHCO_3$ | 60:40 | 0.48 | 0.75 | 4.6 | 8.7 | 40 |
| $Na_2CO_3$ | 90:10 | 0.64 | 2.16 | 6.6 | 8.5 | 0 |
| $Na_2CO_3$ | 80:20 | 0.56 | 1.18 | 9.9 | 8.7 | 0 |
| $Na_2CO_3$ | 70:30 | 0.50 | 1.14 | 11.9 | 8.6 | 0 |
| $Na_3$Citrate | 90:10 | 0.44 | 1.72 | 15.4 | 8.7 | 0 |
| $Na_3$Citrate | 80:20 | 0.45 | 1.42 | 10.7 | 8.5 | 0 |

Table 3 clearly demonstrates the improved spalling resistance of the polymer of the invention compared to bentonite and Table 4 shows the benefit of an addition, typically 10–20%, of the electrolyte.

EXAMPLE 3

The process of Example 1 was repeated with different binders, to give the results in Table 5. The organic binders were used in amounts of 0.07% by weight and were fine powder particles.

TABLE 5

| | Wet Strenth/kg | Dry Strength/kg | Drop No. | % Moisture |
|---|---|---|---|---|
| Blank | 0.60 | 0.50 | 1.4 | 7.3 |
| 60% ACM/40% NaAc(IV = 11.1) | 0.60 | 4.20 | 5.6 | 9.2 |
| Bentonite (0.7% w/w) | 0.88 | 2.95 | 1.7 | 7.7 |
| Carboxyxethyl cellulose | 0.81 | 2.65 | 2.4 | 8.1 |
| Cross linked anionic polymer | 0.41 | 0.59 | 1.6 | 8.8 |
| Cationic polymer blend | 0.59 | 0.83 | 2.5 | 8.6 |

Satisfactory results have also been obtained using, as binder a 60:40 acrylamide:sodium acrylate polymers having IV 3.6 and good results have been obtained at IV about 6 and about 8. These polymers, and a copolymer of 30:70 acrylamide:sodium acrylate IV 7.8, gave better results than acrylamide homopolymer.

EXAMPLE 4

A copolymer of 60% acrylamide 40% sodium acrylate with IV about 6.8 in powder form 100% below 200 μm was used blended with sodium carbonate as a binder, A, in a commercial iron ore pelletisation plant. In a comparative test, B, bentonite was used. The results are in Table 6. The strength values in test A are satisfactory in view of the very low amount of binder that was used. The spalling temperature is remarkably high and this shows a great benefit of the invention.

TABLE 6

| | A | B |
|---|---|---|
| Binder addition kg/ton | | |
| Polymer | 0.22 | |
| Soda $Na_2CO_3$ | 0.15 | |

TABLE 6-continued

| | A | B |
|---|---|---|
| Bentonite | | 7.0 |
| Green ball property | | |
| Moisture % | 9.1 | 9.1 |
| Drop number | 8.5 | 8.6 |
| Compression strength | | |
| Wet (kp) | 0.71 | 0.90 |
| Dry (kp) | 2.07 | 4.50 |
| Spalling temp °C. | >800 | 370 |
| Porosity % | 33.7 | 32.8 |
| Pellets property | | |
| Cold compression strength (kp) | 215 | 266 |
| Tumber Index | 95 | 97 |

EXAMPLE 5

The process of Example 1 was repeated using no added binder (blank) or a blend of 0.02% w/w particles <200 μm of soluble polymer IV 6.8 formed from 60% acrylamide and 40% sodium acrylate with 0.1% w/w or 0.05% w/w particles below 100 μm of cross linked sodium polyacrylate. The results were as follows.

TABLE 7

| Binder | Wet Strength | Dry Strength | Drop No. | % Moisture |
|---|---|---|---|---|
| Blank | 0.42 | 0.40 | 3.0 | 7.4 |
| 0.1% cross linked | 0.68 | 3.03 | 27.1 | 11.5 |
| 0.05% cross linked | 0.67 | 1.61 | 13.3 | 9.5 |

We claim:

1. A process in which iron ore pellets are made by adding binder comprising organic polymer to particulate iron ore having substantially all particles below 250 μm and stirring in the presence of 5 to 15% by weight water (based on total mix) to form a substantially homogeneous moist mixture and pelletising the moist mixture, characterised in that the binder comprises up to 0.2% by weight, based on total mix, of a water soluble synthetic polymer that has intrinsic viscosity 3 to 16 dl/g and that is an anionic polymer of one or more water soluble ethylenically unsaturated monomers comprising an anionic monomer and that is added to the iron ore as a dry, free flowing, powder having substantially all particles above 20 μm and below 300μm.

2. A process according to claim 1 in which the polymer is a copolymer of acrylamide and an ethylenically unsaturated anionic monomer.

3. A process according to claim 1 in which the polymer is a copolymer of sodium acrylate and acrylamide.

4. A process according to claim 1 in which the amount of anionic monomer is from 5 to 60% by weight of the monomers.

5. A process according to claim 1 in which the polymer is a copolymer of 30 to 50% sodium acrylate and 70 to 50% acrylamide.

6. A process according to claim 1 in which the polymer has IV about 4 to about 11 dl/g.

7. A process according to claim 1 in which the polymer has IV of from about 5 to 8 dl/g.

8. A process according to claim 1 in which the polymer is in the form of beads made by reverse phase suspension polymerisation.

9. A process according to claim 1 in which the binder gives a surface tension of above 70 dynes/cm at a concentration in water at 20° C. of 0.075% by weight.

10. A process according to claim 1 in which the amount of polymer is from 0.01 to 0.05% by weight.

11. A process according to claim 1 in which at least 70% by weight of the iron ore has a particle size below 50 μm.

12. A process according to claim 1 in which substantially all the polymer particles are below 150 μm.

13. A process according to claim 1 in which substantially 100% of the polymer particles are below 200 μm and at least 50% are below 100 μm.

14. A process according to claim 1 in which the ore contains 5 to 15% by weight moisture before addition of the polymeric particles.

15. A process according to claim 1 in which the binder comprises 10 to 150%, by weight based on soluble polymer, of a compound selected from urea, sodium acetate, sodium citrate, sodium oxalate, sodium tartrate, sodium benzoate, sodium stearate, sodium bicarbonate, sodium carbonate, sodium silicate and the corresponding ammonium, potassium, calcium or magnesium salts of the preceding salts and calcium oxide.

16. A process according to claim 15 in which the said compound is selected from sodium bicarbonate, sodium carbonate, sodium citrate and sodium silicate.

17. A process according to claim 15 in which the amount of the said compound is 30 to 100% based on the soluble polymer.

18. A process according to claim 1 in which the binder comprises 10 to 600% by weight, based on soluble polymer, of a cross linked, water swellable, anionic polymer having a particle size below 100 μm.

* * * * *